US005337525A

United States Patent [19]

Zaccai et al.

[11] Patent Number: 5,337,525

[45] Date of Patent: Aug. 16, 1994

[54] RAIL SYSTEM

[75] Inventors: Gianfranco Zaccai, Boston; Arthur S. Rousmaniere, Andover; Timothy C. Dearborn, Wellesley; Lynn Noble, Lexington; Thomas J. Misage, Somerville, all of Mass.

[73] Assignee: Herman Miller, Inc., Zeeland, Mich.

[21] Appl. No.: 1,449

[22] Filed: Jan. 7, 1993

Related U.S. Application Data

[62] Division of Ser. No. 848,426, Mar. 6, 1992.

[51] Int. Cl.[5] ..... G04B 2/00

[52] U.S. Cl. ..... 52/35; 52/36.4; 52/512; 52/220.1; 52/281

[58] Field of Search ..... 52/34, 35, 36.4, 716.8, 52/717.05, 718.01, 718.04, 483, 476, 281, 282.1, 287, 290, 235, 512, 220.1

[56] References Cited

U.S. PATENT DOCUMENTS

| | | | |
|---|---|---|---|
| 868,382 | 10/1907 | Williamson . | |
| 1,039,647 | 9/1912 | Carter | 297/256 |
| 1,939,115 | 12/1933 | Fritsche . | |
| 2,114,044 | 4/1938 | Bonnell . | |
| 2,143,034 | 1/1939 | Sakier . | |
| 2,178,817 | 11/1939 | Small | 52/290 X |
| 2,242,461 | 5/1941 | Fisher . | |
| 2,867,013 | 1/1959 | Haag et al. . | |
| 2,947,093 | 8/1960 | Masters | 52/36 X |
| 2,967,309 | 1/1961 | Corp . | |
| 3,008,249 | 11/1961 | Masters | 35/63 |
| 3,098,240 | 7/1963 | Fleenor . | |
| 3,283,340 | 11/1966 | McMurtrie et al. . | |
| 3,458,963 | 8/1969 | Klein . | |
| 3,591,997 | 7/1971 | Tennison et al. . | |
| 3,667,177 | 6/1972 | Biela | 52/35 X |
| 3,775,926 | 12/1973 | Brown et al. . | |
| 3,831,334 | 8/1974 | Rutkowski et al. | 52/287 |
| 3,834,782 | 9/1974 | Pampinella . | |
| 3,873,151 | 3/1975 | Morris et al. . | |
| 3,991,537 | 11/1976 | Brown . | |
| 4,009,903 | 3/1977 | Manspeaker . | |
| 4,040,223 | 8/1977 | Hillstrom | 52/483 |
| 4,087,127 | 5/1978 | Lotta . | |
| 4,196,552 | 4/1980 | Bartlett . | |
| 4,640,076 | 2/1987 | Migliore | 52/509 |
| 4,660,339 | 4/1987 | Paz . | |
| 4,671,026 | 6/1987 | Wissinger . | |
| 4,680,817 | 7/1987 | Sloan et al. . | |
| 4,691,392 | 9/1987 | Whitney . | |
| 4,736,559 | 4/1988 | Young . | |
| 4,750,624 | 6/1988 | Baron | 211/87 |
| 5,127,131 | 6/1992 | Corrigan et al. | 16/114 R |

*Primary Examiner*—Carl D. Friedman
*Assistant Examiner*—Robert J. Canfield
*Attorney, Agent, or Firm*—Willian Brinks Hofer Gilson & Lione

[57] ABSTRACT

A rail system is used for supporting a plurality of upper and lower modular wall panels adjacent a plurality of spaced apart studs. In one aspect of the invention, the rail system includes an upper rail mounted horizontally to the studs adjacent a ceiling, a lower rail mounted horizontally to the studs adjacent an abutting surface such as a floor, bathtub, or shower pan, and a middle rail mounted horizontally to the studs between the lower and upper rails. Each rail is mountable to the studs regardless of the distance therebetween. The upper rail is adapted to receive an upper portion of the upper wall panels, the lower rail is adapted to receive a lower portion of the lower wall panels, and the middle rail is adapted to receive the upper and lower panels. In another aspect of the invention, an elongated bar is spaced apart from the middle rail and adapted to be mounted longitudinally thereto. In yet another aspect of the invention, a seating assembly is supported by the bar and moveable to a desired location in a shower stall. The seating assembly includes a seat and a backrest having a channel formed in an upper portion thereof which is substantially the same shape as the bar such that said upper portion of the backrest slidably fits over the bar.

34 Claims, 6 Drawing Sheets

RAIL SYSTEM

This is a division of application Ser. No. 07/848,426, filed Mar. 6, 1992.

BACKGROUND OF THE INVENTION

The present invention relates generally to wall structures, and more particularly, to an easily constructed rail system for retaining a plurality of bathroom wall panels and attaching a handle bar or other accessories thereto.

In a typical shower stall or bathtub area in a bathroom, a substrate (e.g. drywall) is mounted to a plurality of studs, and tiles are adhesively secured to the drywall. In order to mount the drywall to the studs with conventional fasteners, the precise location of the studs must be ascertained from outside the drywall. The studs must also be located from outside the tiles in order to mount a handle bar or other accessories thereto. In addition, securing the tiles to the drywall tends to take a substantial amount of time.

Furthermore, accessories to be attached to such a wall structure must be configured with a mounting surface which can be aligned with the studs. However, the distance between the studs often varies depending on the requirements of a particular bathroom. To accommodate for this variance in stud location, the accessory mounting surfaces are typically extendible or oversized, which may be inconvenient, unsightly, costly, and less secure. It would also be costly and inconvenient to have a mounting surface custom-made according to the stud location in a particular bathroom. In addition, the location of an accessory in a bathroom having such a wall structure is restricted by the location of studs.

A number of prior art references relate to wall panel framing systems. In U.S. Pat. No. 2,114,044 (Bonnell), a system for securing panels to a wall is disclosed. The system includes vertical strips which secure side edges of the panels, and upper and lower horizontal strips which secure top and bottom edges of the panels. The strips are mounted to a wall and have longitudinal grooves therein for receiving the panels.

A paneling system for elevator cabs is disclosed in U.S. Pat. No. No. 3,458,963 (Klein). The Klein system includes vertical brackets mounted to the walls of an elevator cab. The brackets have channels therein which receive side edges of the wall panels.

In U.S. Pat. No. 4,736,559 (Young), a raised paneling system is disclosed in which a plurality of panels are adhesively secured to a substrate. A horizontal chair rail divides panel sheets into upper and lower sections. The chair rail includes a downwardly extending channel which receives an upper edge of a lower chair rail base, and a panel molding member which receives the lower edge of the chair rail base.

A wall system is disclosed in U.S. Pat. No. 4,660,339 (Paz) comprising a grid constructed of horizontal main support channels secured to a wall and vertical standards connected to the front of the channels. Side edge portions of the panels are mounted to support members which are secured to the standards. Top and bottom channels are also provided for securing top and bottom edge portions of the panels.

In U.S. Pat. No. 2,867,013 (Haag), a preformed metal wall base includes a channel-shaped plaster supporting member which holds a lathing and wall finishing plaster. U.S. Pat. No. 3,591,997 to Tennison, Jr. discloses a channel-shaped bracing member that includes a multiplicity of openings so that the brace can be connected to studs.

In U.S. Pat. Nos. 3,775,926 (Brown), 3,991,537 (Brown), and 4,196,552 (Bartlett), shock-absorbing rails are disclosed which are mounted to a wall for absorbing the impact from chairs or other moveable articles. Bathroom hand rail fixtures mounted directly to a bathroom wall are disclosed in U.S. Pat. Nos. 2,242,461 (Fisher) and 3,098,240 (Fleenor). In U.S. Pat. Nos. 3,873,151 (Morris), 4,009,903 (Manspeaker), and 4,087,127 (Lotta), wall mounted seats are disclosed which are pivotable between a horizontal and vertical position.

SUMMARY OF THE INVENTION

Briefly stated, the invention is directed to a rail system for supporting a plurality of upper and lower modular wall panels adjacent a plurality of spaced apart studs. In one aspect of the invention, the rail system includes an upper rail mounted horizontally to the studs adjacent a ceiling, a lower rail mounted horizontally to the studs adjacent an abutting surface such as a floor, bathtub, or shower pan, and a middle rail mounted horizontally to the studs between the lower and upper rails. Each rail is mountable to the studs regardless of the distance between the studs. The upper rail is adapted to receive an upper portion of the upper wall panels, the lower rail is adapted to receive a lower portion of the lower wall panels, and the middle rail is adapted to receive the upper and lower panels. In another aspect of the invention, an elongated bar is spaced apart from the middle rail and adapted to be mounted longitudinally thereto. Attachment means are coupled to the bar and rail for mounting the bar to the rail. In yet another aspect of the invention, a seating assembly is supported by the bar and moveable to a desired location in a shower stall. The seating assembly includes a seat and a backrest having a channel formed in an upper portion thereof which is substantially the same shape as the bar such that said upper portion of the backrest slidably fits over the bar.

In a preferred embodiment, the upper rail has a downwardly extending channel therein, the lower rail has an upwardly extending channel therein, and the middle rail has an upwardly and downwardly extending channel therein for receiving the panels. Each rail preferably includes a vertical plate which bears against the studs and means for receiving a plurality of fasteners for mounting the rails to the studs. The means for receiving the fasteners are adapted to completely receive said fasteners to prevent interference between the fasteners and the panels such that the panels bear against a front surface of the corresponding plates. A cover is adapted to be attached to the middle rail and has a wall spaced apart from the rail to define an interior chamber therebetween for the laying of cables, pipes or tubing therein. The cover also has a plurality of apertures therein for receiving the elongated bar attachment means. A base cover is also adapted to be attached to the lower rail.

The upper rail preferably includes a horizontal crown member extending outward and curving upward from a top portion thereof. The crown member has a portion depending downwardly therefrom which is spaced apart from the plate to create the downwardly extending channel, and is preferably shaped such that a plurality of accessories can be removably secured thereto. The middle rail plate preferably includes upper and lower portions which bear against the studs and upper and lower horizontal flanges extending outward from said upper and lower portions to define the channels. In one embodiment of the middle rail, the channels are further defined by upper and lower vertical flanges extending from the horizontal flanges of the middle rail plate. In another embodiment, the horizontal flanges have a protuberance extending vertically outward from outer edges thereof and the channels are further defined by edge portions of the cover. In one embodiment of the cover, horizontal flanges extend inward from top and bottom edges thereof for receiving the panels. The cover flanges have a longitudinal groove formed in an inner surface thereof approximately the same size as the protuberances for securing the cover to the plate. In another embodiment of the cover, upper and lower curved edge portions further define the middle rail channels.

The attachment means for the elongated bar preferably comprises a plurality of base members attached to the middle rail plate and joint members connecting the base members to the bar. The joint members are adapted to interconnect two opposing bars in axial alignment.

Preferably, the seat is rotatable between a horizontal position and a vertical position, and means are provided for supporting a lower portion of the seating assembly against a wall.

The present invention, together with further objects and advantages, will be best understood by reference to the following detailed description taken in conjunction with the accompanying drawings.

DETAILED DESCRIPTION OF THE PREFERRED EMBODIMENTS

Figure 1:
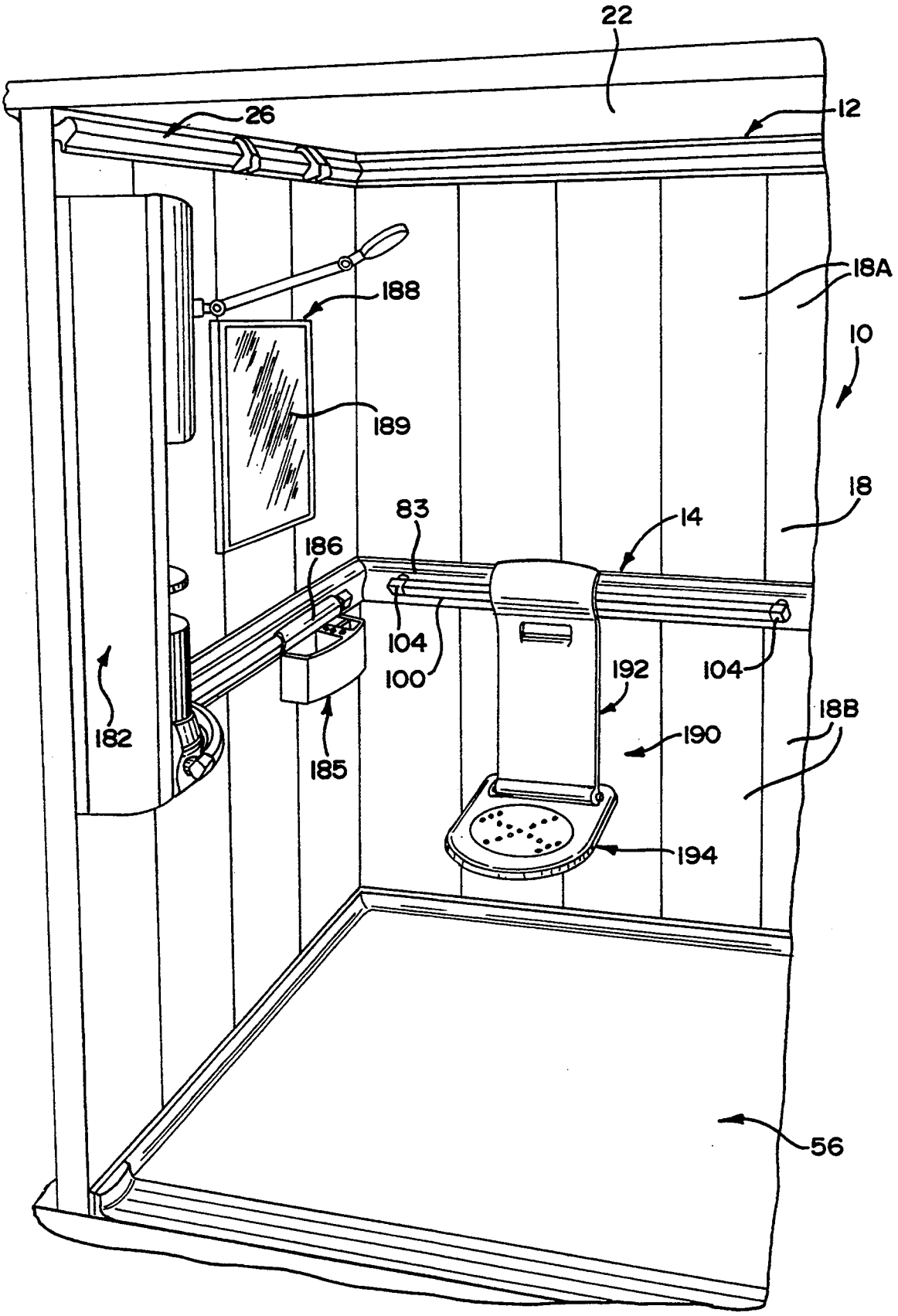
FIG. 1 is a perspective view of a preferred embodiment of the invention showing a rail system installed in a shower stall of a bathroom with a seat attached to a middle rail bar.
Figure 2:
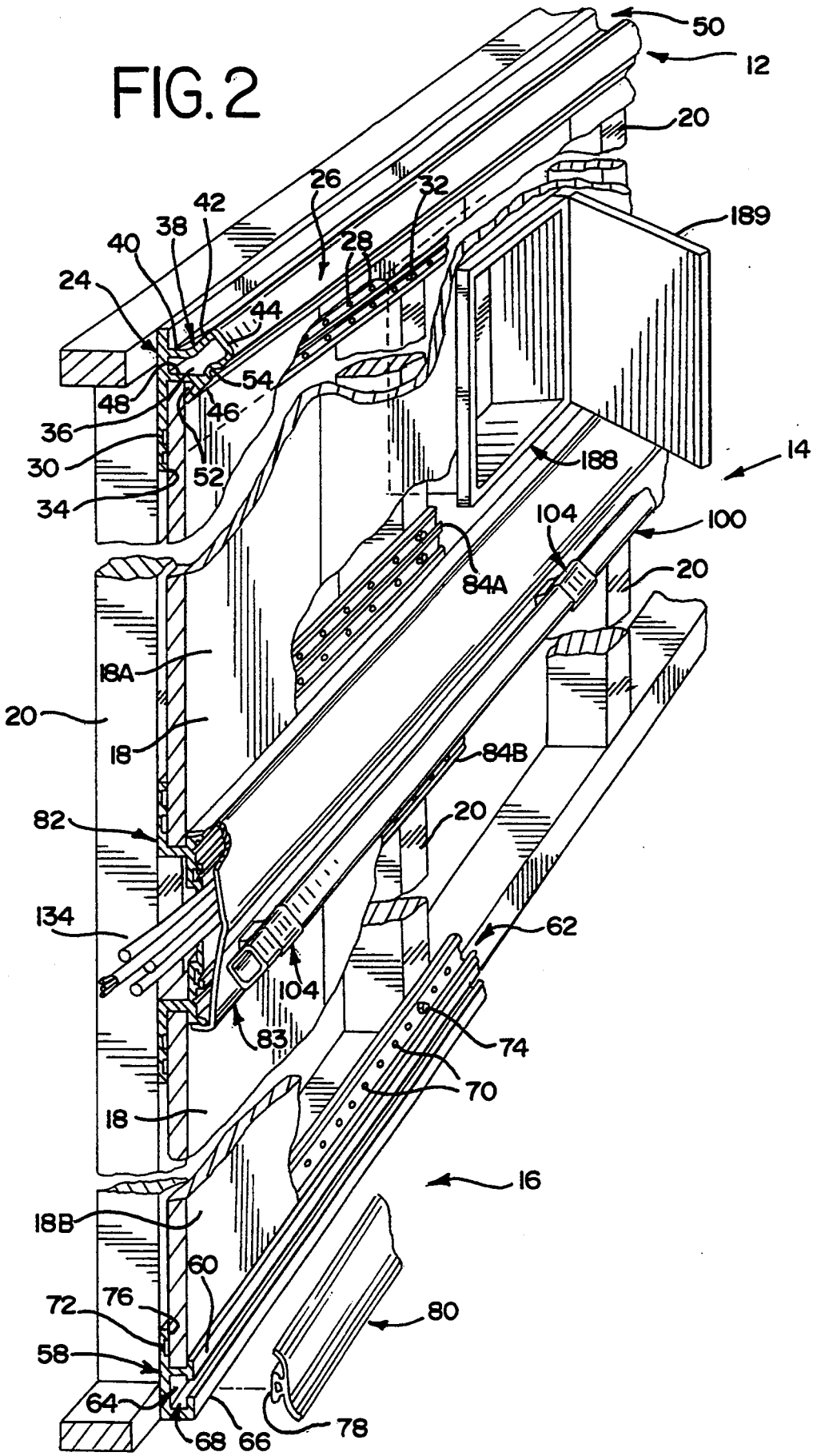
FIG. 2 is a fragmentary perspective view of the rail system shown in FIG. 1.

Referring to the drawings, FIGS. 1 and 2 show a preferred embodiment of a rail system indicated generally at 10. The rail system 10 includes an upper rail 12, a middle rail 14, and a lower rail 16 which support a plurality of wall panels 18 including upper panels 18A and lower panels 18B. The rails 12, 14, and 16 are mounted horizontally to a plurality of spaced apart studs 20. The studs 20 can be part of a standard bathroom wall construction, or part of a prefabricated, movable frame structure.

The upper rail 12 is mounted horizontally to the studs 20 adjacent a ceiling 22. Upper rail 12 includes a vertical plate 24 which bears against the studs 20 and a horizontal crown member 26 extending outward from a top portion of plate 24. The plate 24 has a plurality of spaced apart apertures 28 therein in alignment with a plurality of longitudinal notches 30 formed in a bottom portion of plate 24. The apertures 28 receive conventional fasteners 32 such that the heads of said fasteners are completely received within the notches 30, thus allowing the upper panels 18A to bear against a front surface 34 of the plate 24. The spaced apart apertures 28 allow the upper rail 12 to be secured to the studs 20 by the fasteners 32 regardless of the distance between the studs 20. The apertures 28 can also be drilled in a desired location in alignment with the studs 20 when installing the rail system 10. Any type of recess can be formed in the plate 24 which provides clearance for the heads of the fasteners 32, such as countersunk holes or the like.

Preferably, the crown member 26 has an interior chamber 36 for the laying of cables therein (not shown). The interior chamber 36 is defined by a top wall 38 including a substantially horizontal portion 40 and an upwardly extending portion 42, a first side wall 44 depending downwardly from the top wall at an angle away from the plate 24, a second side wall 46 depending downwardly from the first side wall 44 at an angle toward the plate 24, and a substantially horizontal bottom wall 48 between the plate 24 and the second side wall 46. The plate 24 and the top wall 38 define an upwardly extending channel 50 for the placing of a longitudinal light therein (not shown), and the second side wall 46 extends downward past the bottom wall 36 to form a downwardly extending channel 52 for receiving an upper portion of the upper wall panels 18A. Preferably, the second wall 46 also has a longitudinal notch 54 formed in an exterior surface thereof for receiving various accessories.

Crown member 26 can be any shape as long as it has a downwardly extending channel in a bottom portion thereof for receiving the upper portion of the upper panels 18A. In addition, the crown member 26 can be any shape which allows a plurality of accessories to be removably attached thereto, although it is desirable for the crown member to curve upward to provide a suitable anchor.

As shown in FIG. 1, the lower rail 16 is mounted horizontally to the studs 20 adjacent a shower stall floor 56. The lower rail 16 can be mounted adjacent any lower abutting surface such as the top surface of a bathtub or the side wall of a shower pan. Lower rail 16 preferably includes a vertical plate 58 which bears against the studs 20, a T-shaped member 60 extending outwardly from plate 58 to create an upwardly extending channel 62 and a downwardly extending channel 64, and a J-shaped member 66 extending outward from a lower edge thereof to create an upwardly extending channel 68.

The plate 58 has a plurality of spaced apart apertures 70 therein in alignment with a longitudinal notch 72 formed in a top portion of plate 58. The apertures 70 receive conventional fasteners 74 such that the heads of said fasteners are completely received within the notch 72, thus allowing the lower panels 18B to bear against a front surface 76 of the plate 58. The spaced apart apertures 70 allow the lower rail 16 to be secured to the studs 20 by the fasteners 74 regardless of the distance between the studs 20. The apertures 70 can also be drilled in a desired location in alignment with the studs 20 when installing the rail system 10. Furthermore, any type of recess can be formed in the plate 58 which provides sufficient clearance for the heads of the fasteners 74, such as countersunk holes or the like.

The upwardly extending channel 62 formed by T-shaped member 60 and plate 58 receives a lower portion of the lower panels 18B. The lower rail 16 can be any shape as long as it has an upwardly extending channel in a top portion thereof for receiving the upper panels 18B. The downwardly extending channel 64 of T-shaped member 60 and the upwardly extending channel 68 of J-shaped member 66 releasably receive an attachment portion 78 extending inward from a base cover 80. The base cover 80 can be attached to the lower rail 16 by any conventional fastening means, although it is desirable for the attachment portion 78 to be configured such that the cover 80 can be releasably snapped into place.

Figure 4:
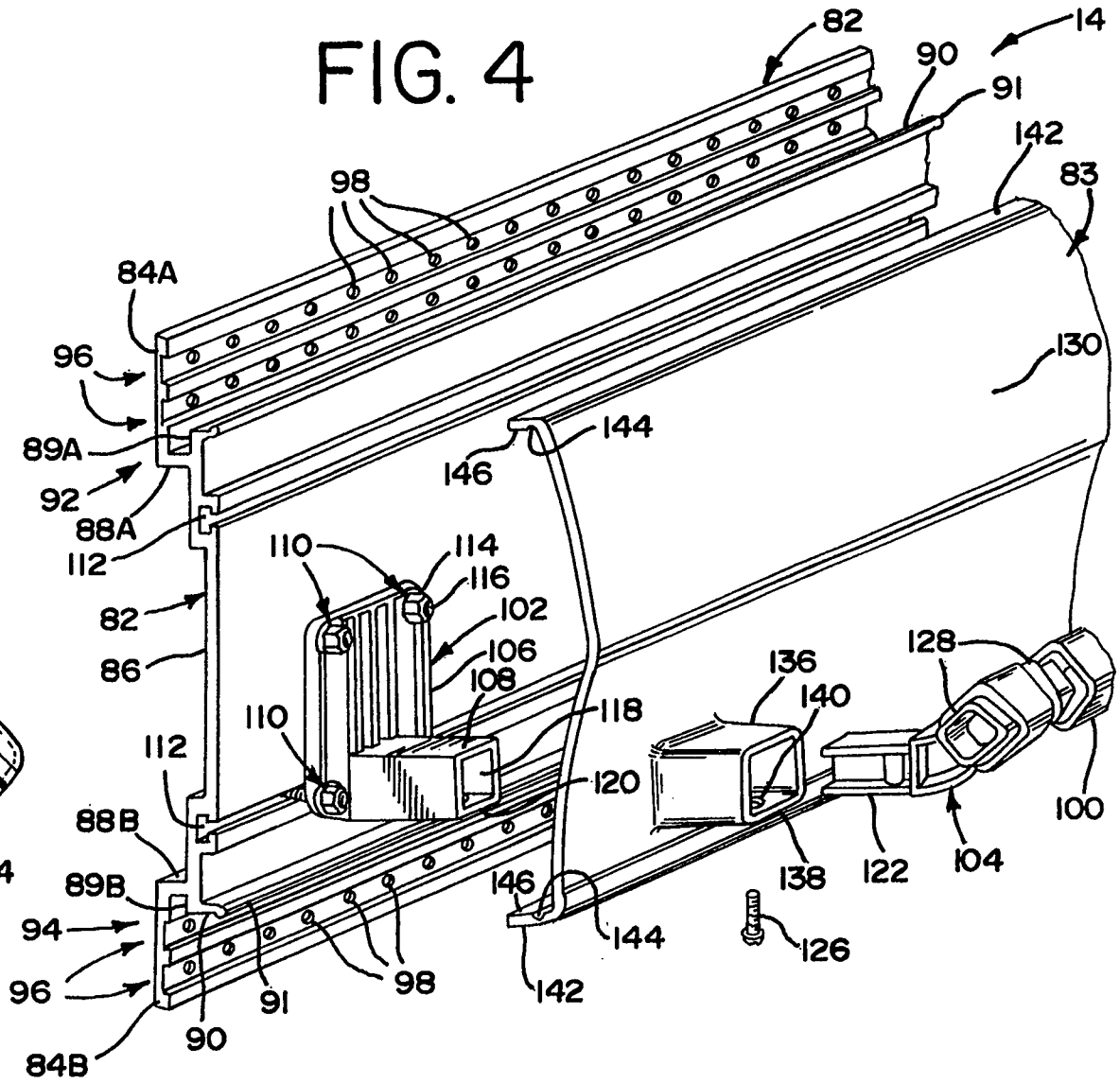
FIG. 4 is a fragmentary perspective view of the middle rail and bar shown in FIG. 3.
Figure 3:
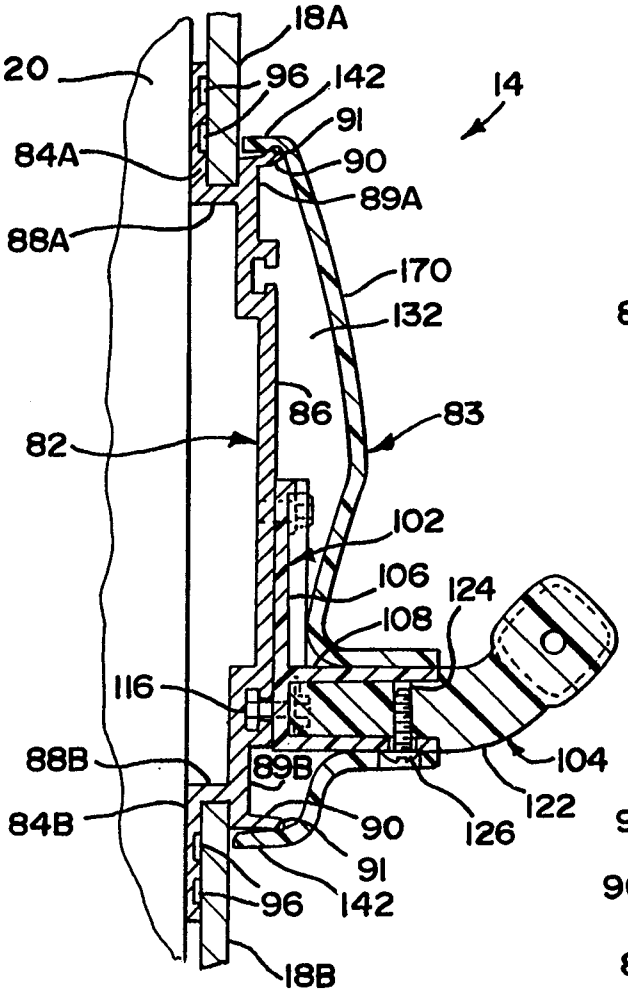
FIG. 3 is a cross-sectional view of a preferred embodiment of a middle rail and bar.

The middle rail 14 is mounted horizontally to studs 20 between the upper rail 12 and the lower rail 16. As best shown in FIGS. 2–4, middle rail 14 includes a vertical plate 82 and a cover 83. Vertical plate 82 has an upper portion 84A and lower portion 84B bearing against the studs 20, and a middle portion 86 preferably spaced apart from the studs 20. An upper horizontal flange 88A and a lower horizontal flange 88B interconnect the middle portion 86 and upper and lower portions 84A and 84B of plate 82. An upper vertical flange 89A extends upward from the upper horizontal flange 88A, and a lower vertical flange 89B extends downward from the lower horizontal flange 88B. In addition, horizontal flanges 90 extend outward from the vertical flanges 89A and 89B, and a protuberance 91 extends substantially vertically outward from each horizontal flange 90. Thus, the upper portion 84A, the upper horizontal flange 88A, and the upper vertical flange 90A of plate 82 define an upwardly extending channel 92 for receiving a lower portion of the upper panels 18A. Similarly, the lower portion 84B, the lower horizontal flange 88B, and the lower vertical flange 90B of plate 82 define a downwardly extending channel 94 for receiving an upper portion of the lower panels 18B.

To provide a flat surface for supporting the panels 18, the upper portion 84A and lower portion 84B of plate 82 have spaced apart, longitudinal, substantially rectangular notches 96 therein. A plurality of spaced apart apertures 98 are formed in the plate 82 in alignment with the notches 96. The apertures 98 receive conventional fasteners (not shown) such that the heads of said fasteners are completely received within the notches 96 to prevent interference between the fasteners and the panels 18. The spaced apart apertures 98 allow the middle rail 14 to be secured to the studs 20 by the fasteners regardless of the distance between the studs 20.

Apertures 98 can also be drilled in a desired location in alignment with the notches 96 and studs 20 when installing the rail system 10. Any type of recess can be formed in the plate 82 which provides clearance for the heads of the fasteners, such as countersunk holes or the like. In addition, the middle rail plate 82 can be any configuration which is mountable to the studs and provides upwardly and downwardly extending channels for receiving the panels 18. For example, the middle portion 86 of the plate 82 can bear against the studs 20, and recesses and apertures can be formed in the middle portion 86 of the plate for receiving fasteners therein.

The middle rail 14 also includes a plurality of elongated bars 100 spaced apart from the rail and mounted longitudinally thereto by attachment means. The attachment means comprises a plurality of base members 102 attached to the middle portion 86 of the middle rail plate 82, and a plurality of joint members 104 interconnecting the base members 102 to the bar 100.

The base members 102 include a support plate 106 bearing against the middle portion 86 of the middle rail plate 82, and a rectangular post 108 extending perpendicularly outward therefrom. The support plates 106 have a plurality of apertures (not shown) therein for receiving a plurality of fasteners 110. To align the support plates 106 horizontally, the middle rail plate 82 has a longitudinal, rectangular channel 112 in the middle portion 86 thereof adjacent the horizontal flange 88B. Preferably, the fasteners 110 comprise a plurality of nuts 114 and square head bolts 116, and the rectangular channel 112 is approximately the same size as the heads of bolts 116 so that the support plate 106 can be secured to the middle rail plate 82 by turning the nuts 114 while the bolts 116 remain fixed within the channel 112. In addition, the posts 108 have a rectangular interior chamber 118 therein and an aperture (not shown) in a bottom wall 120.

To secure the joint members 104 to the base members 102, the joint members 104 have a support arm 122 which is inserted into the interior chamber 118 of the base member posts 108. Each support arm 122 has a hole 124 in alignment with the aperture in the base member post 108 for the insertion of a fastener 126 to secure the joint member 104 to the base member 102. The joint members 104 also have a pair of rectangular, opposing hub portions 128 extending horizontally therefrom in an angular relation relative to a vertical plane. End portions of the rectangular bar 100 mate with the hub portions 128 such that the bar is positioned in an angular relation relative to the vertical plane.

Thus, the base members 102 are mounted to the rail plate 82 in a desired position in alignment with the channel 112, and the hub portions 128 of the joint members 104 mate with end portions of bar 100 to support a single bar or interconnect separate bars in a horizontal position. In addition, a cap (not shown) can be provided to mate with an end hub portion 128. The bar 100 can therefore be mounted in a desired position along a wall regardless of the location of the studs 20, and the angular relation of the bar 100 provides a natural configuration for comfortably grabbing the bar with a hand. In addition, the angular configuration of the rectangular bar allows various accessories to be removably attached thereto. The bars 100 can be mounted to the middle rail plate 82 by any attachment means, although it is desirable to provide separate components to facilitate assembly and disassembly of the bars in a desired location.

The cover 83 has a wall 130 spaced apart from the middle rail plate 82 which defines an interior chamber 132 between said cover and plate for the insertion of cables 134, pipes or tubing therebetween. A plurality of rectangular sleeves 136 extend outward from the cover wall 130 and receive the support plate posts 108. A wall 138 of each sleeve 136 has an aperture 140 in alignment with the corresponding base member post aperture (not shown) and support arm hole 124 for receiving fastener 126. To secure the cover 83 to the middle rail plate 82, upper and lower horizontal flanges 142 extend inward from top and bottom edges of the cover 83. The cover flanges 142 have a longitudinal groove 144 formed in an inner surface 146 approximately the same size as the protuberances 91 for securing the cover 83 to the plate. Although the cover 83 can be attached to the middle rail plate by any suitable attachment means, this embodiment facilitates installation and removal of the cover 83 since the joint members 104 are removably attached to the base members 102, and the cover flanges 142 bear against a front surface of the panels 18.

Figure 5:
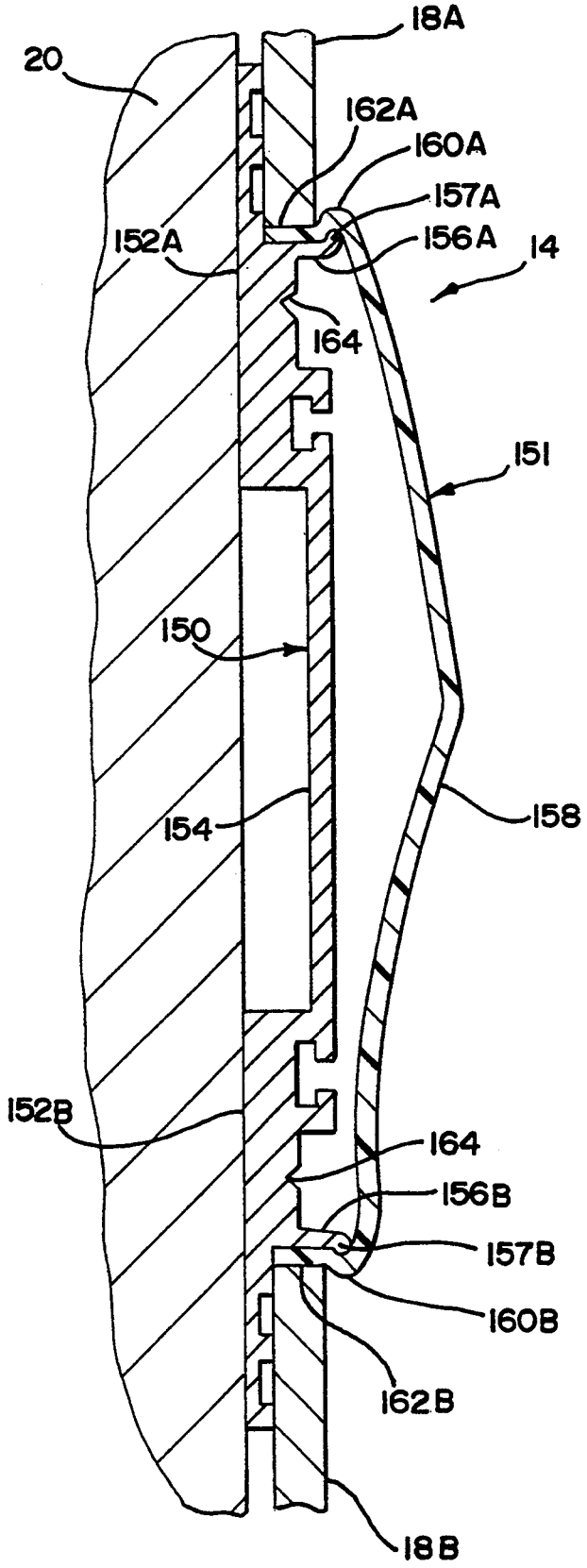
FIG. 5 is a cross-sectional view of an alternative embodiment of the middle rail.

A second embodiment of the invention is shown in FIG. 5. The middle rail 14 includes a vertical plate 150 and a cover 151. The vertical plate 150 has an upper portion 152A and lower portion 152B bearing against the studs 20, and a middle portion 154 spaced apart from the studs 20. An upper horizontal flange 156A having a protuberance 157A extends outward from the upper portion 152A, and a lower horizontal flange 156B having a protuberance 157B extends outward from the lower portion 152B of the plate 150. The cover 151 has a wall 158 spaced apart from the plate 150, an upper edge portion 160A curving downward and mating with protuberance 157A, and a lower edge portion 160B curving upward and mating with protuberance 157B. An upper horizontal flange 162A extends toward plate 150 from the upper curved portion 160A, and a lower horizontal flange 162B extends toward plate 150 from the lower curved portion 160B. The cover flanges 162A and 162B bear against the plate flanges 156A and 156B. Thus, the upper portion 152A of plate 150, the upper horizontal flange 162A of the cover 151, and the curved portion 160A of the cover define an upwardly extending channel which receives a lower portion of the upper panels 18A. Similarly, the lower portion 152B of plate 150, the lower horizontal flange 162B of the cover 151, and the curved portion 160B of the cover define a downwardly extending channel which receives an upper portion of the lower panels 18B. To provide an alternative mounting means, the upper and lower portions 152A and 152B have a longitudinal notch 164 formed therein for guiding the drilling of holes therethrough.

Figure 5A:
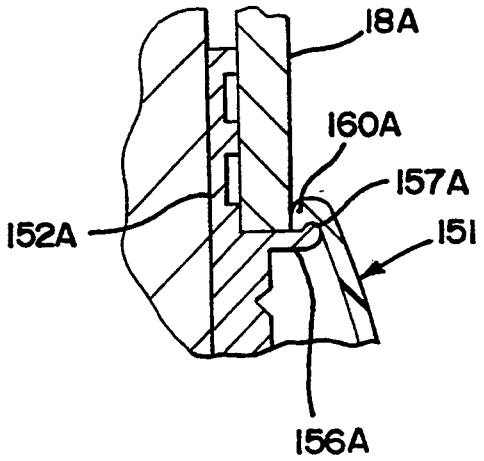
FIG. 5A is fragmentary cross-sectional view of another embodiment of the middle rail.

A third embodiment of the invention is shown in FIG. 5A. In this embodiment, the horizontal flanges 162A and 162B of the cover 151 are omitted. Thus, the upwardly and downwardly extending channels are defined by the upper and lower portions 152A and 152B of the plate 150, the horizontal flanges 156A and 156B of the plate 150, and the curved portions 160A and 160B of cover 151.

Figure 6A:
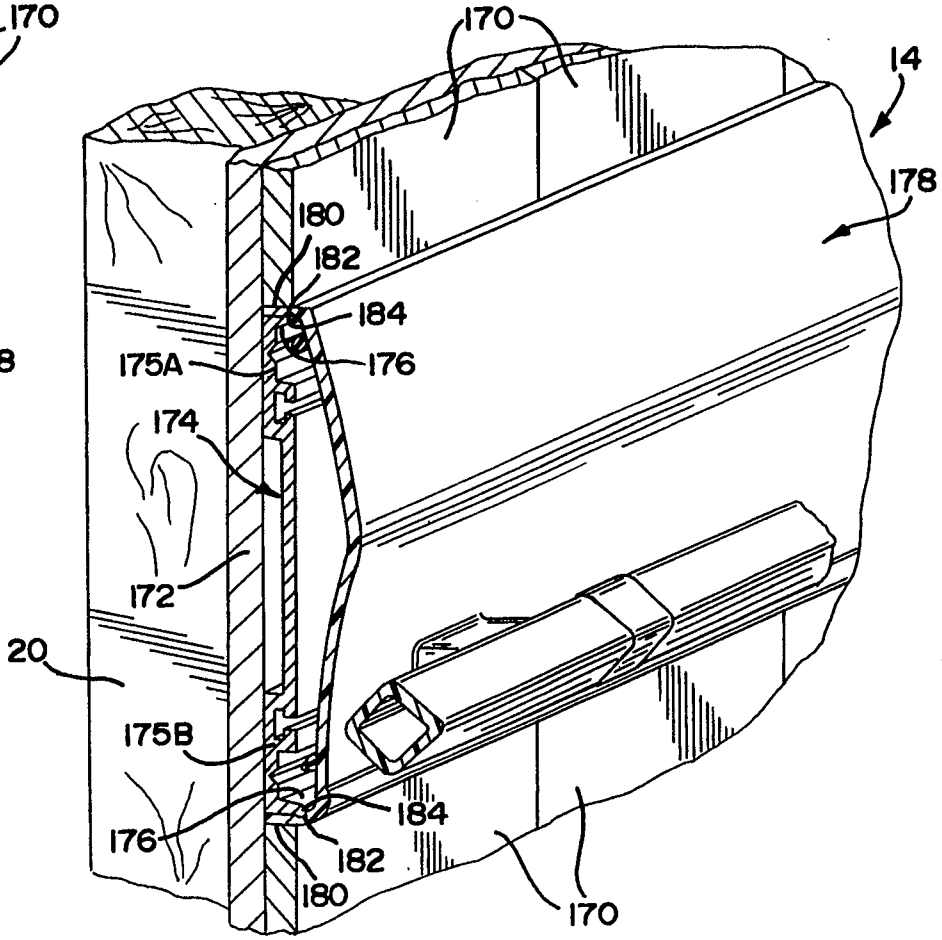
FIG. 6A is a fragmentary perspective view of the rail shown in FIG. 6.
Figure 6:
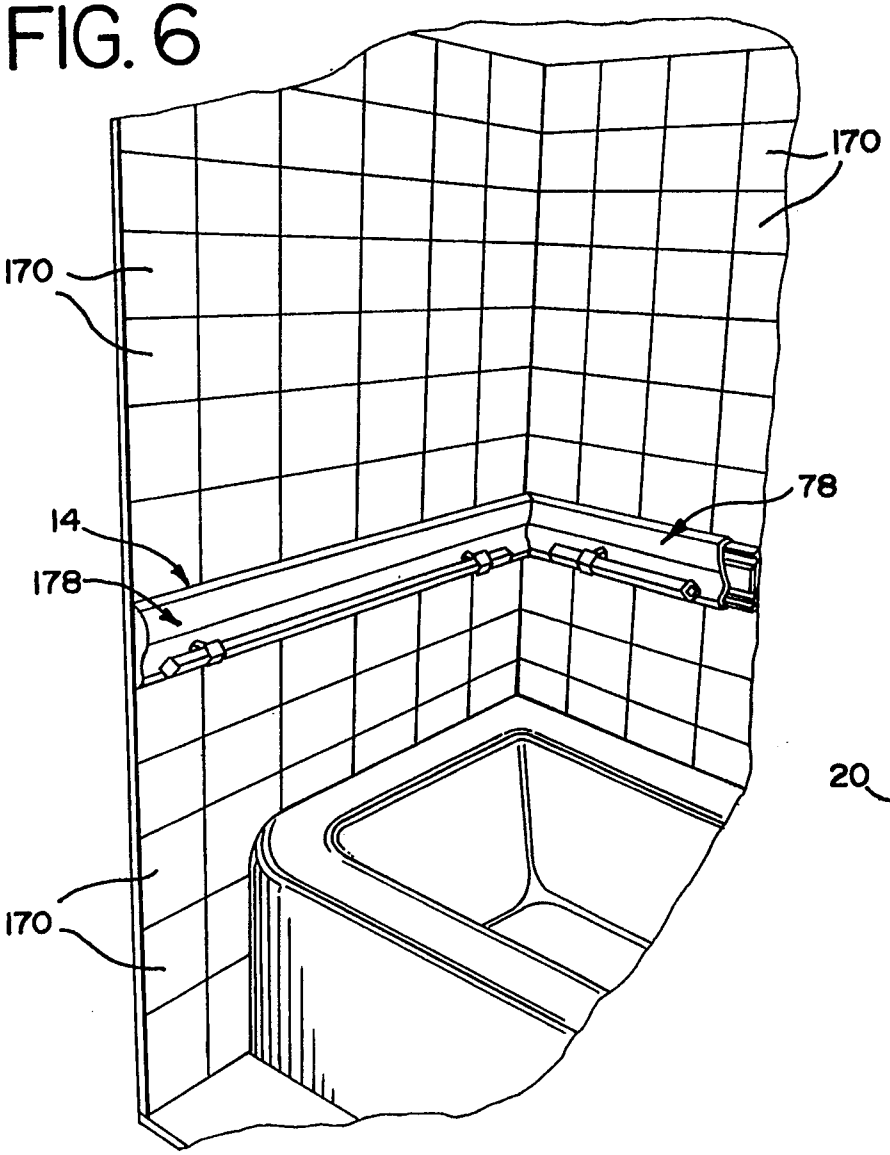
FIG. 6 is a perspective view of yet another embodiment of the invention showing a rail in a shower stall with conventional walls and tiling.

A fourth embodiment of the invention for use with conventional bathroom walls is shown in FIG. 6. The upper and lower rails are omitted, and a plurality of tiles 170 are adhesively secured to a substrate 172, such as drywall, which is mounted to the studs 20. In this form of the invention, a vertical plate 174 includes an upper portion 175A and a lower portion 175B which bear against the substrate 172. A horizontal flange 176 extends outward from a top edge of the upper portion 175A and from a bottom edge of the lower portion 175B. A cover 178 has upper and lower horizontal flanges 180 extending inward from top and bottom edges thereof. Each cover flange 180 has a longitudinal groove 182 therein which mates with a corresponding protuberance 184 extending outward from the plate flanges 174. The cover flanges 180 extend to the substrate 172 such that edges of the tiles 170 bear against the cover flanges 180.

In all of the aforesaid embodiments, the junctures of the panels and covers are caulked to prevent water from entering therebetween. Preferably, the middle rail 14 is approximately waist height, and the bar 100 has a resilient foam or vinyl sleeve with rounded comers to provide a comfortable handle bar. The middle rail cover and the lower rail base cover are preferably made of suitable plastic. To provide added support for the panels, a plurality of vertical spacers can be mounted between adjacent rails and positioned between the panels.

Another aspect of the invention is the attachment of various accessories to the bar 100 and the rail plates 24, 58, and 82. In FIG. 1, a water column 182 of the type disclosed in U.S. patent application Ser. No. 07/848,711 is shown attached to the upper rail plate 24 and middle rail plate 82. A container 185 has a partially enclosed sleeve 186 which is the same shape as the bar 100 for releasably securing the container 185 to the bar. Various other accessories such as soap dishes, shampoo dispensers, or the like can be similarly attached to the bar 100. A cabinet 188 including a mirror 189 can also be positioned between the studs 20 and adapted to be connected to an upper panel 18A.

Figure 7:
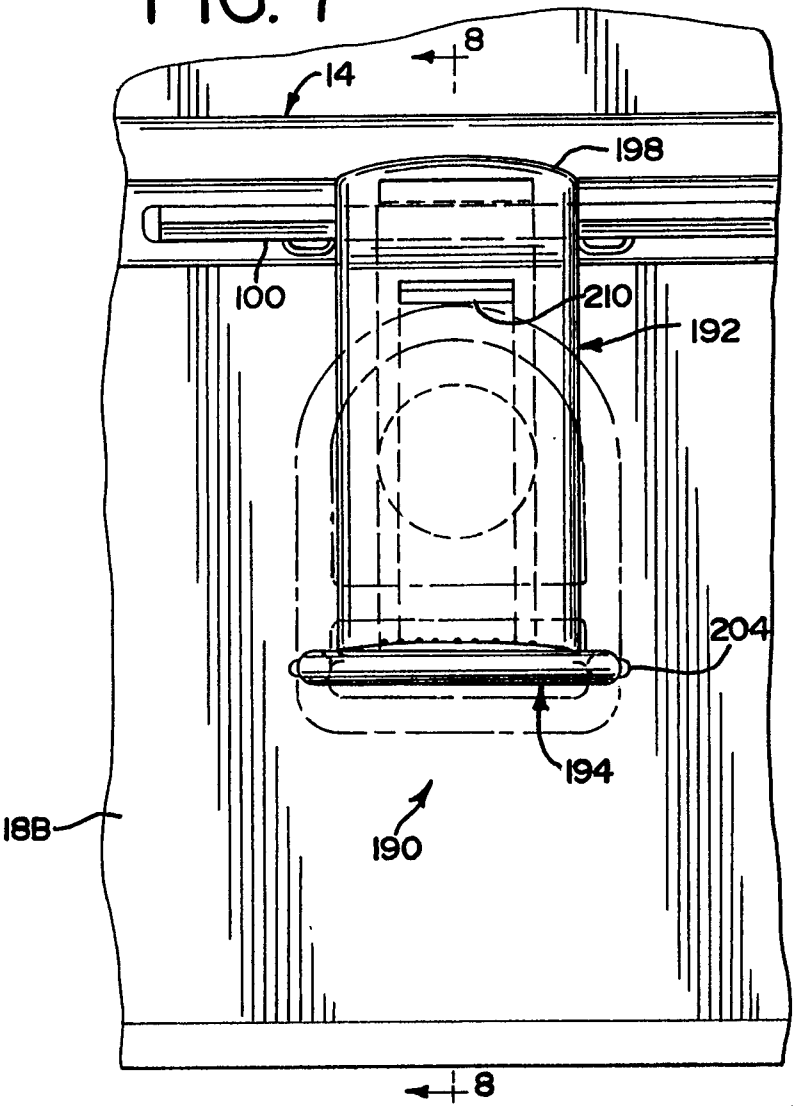
FIG. 7 is a front view of a foldable seat assembly removably attached to the bar of the rail system.
Figure 8:
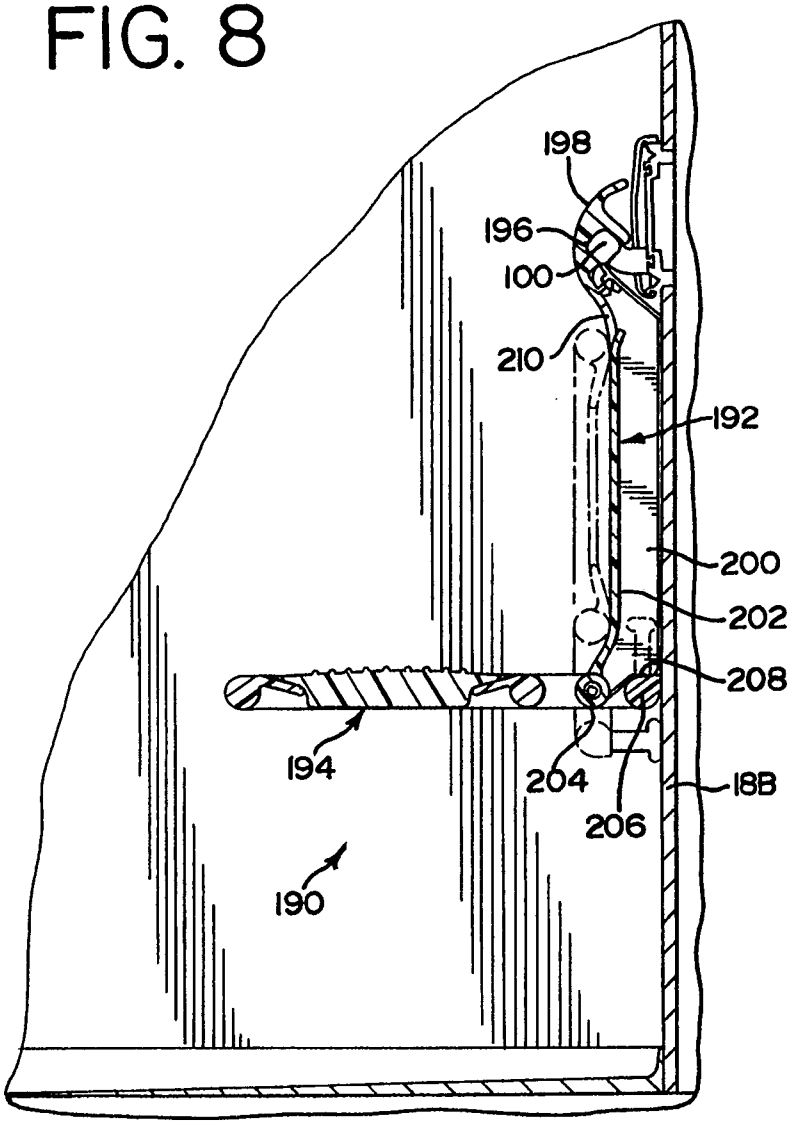
FIG. 8 is a side view of the seat assembly shown in FIG. 7.

As best shown in FIGS. 7–8, a seating assembly 190 includes a backrest 192 and a seat 194. The backrest 192 has a rectangular channel 196 formed in a horizontal upper portion 198 which is the same shape as the rectangular bar 100. A pair of spaced apart vertical ribs 200 extend outward from a back surface 202 of the backrest 192. The angular orientation of the rectangular channel 196 relative to the vertical plane is the same as the angular orientation of the bar 100 so that when the upper portion 198 of backrest 192 is slidably placed over the bar 100, the backrest 192 lies in a vertical plane and the ribs 200 rest against the lower panels 18A.

The seat 194 is rotatably connected to a pivot bar 204 extending from a bottom portion of the backrest 192, and a back edge portion 206 of the seat 194 bears against a bottom edge 208 of the ribs 200 when the seat is in a horizontal position. In addition, the backrest 192 has a cut-out 210 therein to allow a person to grab the seating assembly 190 and move it to a desired location within a shower stall.

Thus, a bathroom rail system is provided which is mountable to the studs regardless of the distance therebetween and includes upwardly and downwardly extending channels to facilitate the installation and removal of wall panels. A plurality of horizontal bars of a desired length are mountable to the middle rail in a desired location regardless of the distance between the studs. In addition, various accessories such as a seating assembly, soap dishes, etc., can be removably attached to the bar.

Although the present invention has been described with reference to preferred embodiments, workers skilled in the an will recognize that many changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A rail system for supporting a plurality of upper and lower modular wall panels adjacent a plurality of spaced apart studs to define a wall, the rail system comprising:

a plurality of spaced apart studs;

an upper rail mounted horizontally to the studs adjacent a ceiling, said upper rail adapted to receive and retain an upper portion of the upper wall panels;

a lower rail mounted horizontally to said studs adjacent an abutting surface such as a floor, bathtub, or shower pan, the lower rail adapted to receive and retain a lower portion of the lower all panels;

a middle rail mounted horizontally to said studs between the lower and upper rails, the middle rail adapted to receive and retain said upper and lower panels;

an elongated bar spaced apart from said middle rail and mounted longitudinally thereto, whereby said bar can be mounted in a desired position along a wall regardless of the location of the studs, a person can grab the bar for support, and various accessories can be removably attached thereto; and a plurality of attachment devices coupled to the bar and middle rail for mounting said bar to said middle rail.

2. The system of claim 1, further comprising a cover attached to the middle rail, said cover having a wall spaced apart from the middle rail to define an interior chamber therebetween.

3. The system of claim 1 wherein the upper rail has a downwardly extending channel therein, the lower rail has an upwardly extending channel therein, sand the middle rail has an upwardly extending channel and a downwardly extending channel therein.

4. The system of claim 3, wherein each rail includes a vertical plate which bear against the studs and means for receiving a plurality of fasteners for mounting said rails to the studs, said means being adapted to completely receive the fasteners to prevent interference between the fasteners and the panels such that the panels bear against a front surface of the corresponding plates.

5. The system of claim 4, wherein the upper rails includes a horizontal crown member extending outward from a top portion thereof, said crown member having a portion depending downwardly therefrom which is spaced apart from the plate to create said downwardly extending channel.

6. The system of claim 5, wherein the crown member curves upward and is shaped such that a plurality of accessories can be removably secured thereto.

7. The system of claim 6, wherein the crown member has an interior chamber for the laying of cables therein.

8. The system of claim 4, further comprising a base cover attached to the lower rail, said lower rail having means for receiving the base cover.

9. The system of claim 8, wherein the base cover has a portion extending outward therefrom which fits into a channel formed in a lower portion of the lower rail plate.

10. The system of claim 4, wherein the middle rail plate includes upper and lower portions which bear against the studs and upper and lower horizontal flanges extending outward from said upper and lower portions to define said channels.

11. The system of claim 10, further comprising a cover attached to the middle rail, the cover having a wall spaced apart from the middle rail plate to define an interior chamber between said cover and plate for the insertion of cables therein.

12. The system of claim 11, wherein the middle rail channels are further defined by upper and lower vertical flanges extending from the horizontal flanges of the middle rail plate.

13. The system of claim 1, wherein the attachment devices each comprises a base member attached to the middle rail plate and a joint member interconnecting said base member to the bar.

14. The system of claim 13, wherein each base member comprises a support plate bearing against the middle rail plate and a post extending perpendicularly outward therefrom, and each joint member has a support arm which mates with a corresponding post and an end portion extending laterally therefrom which mates with an end portion of said bar.

15. The system of claim 14, further comprising a cover attached to the middle rail, the cover having a wall spaced apart from the rail plate to define an interior chamber therebetween the cover also having a plurality of apertures therein for receiving the attachment devices.

16. The system of claim 15, wherein the middle rail plate has horizontal flanges extending outward from top and bottom edges thereof with a protuberance extending substantially vertically outward from outer edges of said flanges, and the cover has a horizontal flanges extending inward from top and bottom edges thereof, said cover flanges having a longitudinal groove formed in an inner surface thereof. approximately the same size as said protuberances for securing the cover to the plate.

17. The system of claim 1, further comprising a seating assembly supported by the bar and movable to a desired location along said bar, said seating assembly having a backrest and a seat, the backrest having a channel formed in an upper portion thereof which is substantially the same shape as the bar such that said upper portion of the backrest slidably fits over the bar.

18. A rail system for supporting a plurality of upper and lower modular wall panels adjacent a plurality of spaced apart studs to define a wall, the rail system comprising:

a plurality of spaced apart studs;

an upper rail mounted horizontally to the studs adjacent a ceiling, the upper rail including a vertical plate which bears against the studs and a horizontal crown member extending outward from a top portion thereof, said crown member having a portion depending downwardly therefrom which is spaced apart from the plate to create a downwardly extending channel for receiving the upper portion of the upper wall panels;

a lower rail mounted horizontally to the studs adjacent an abutting surface such as a floor, bathtub, or shower pan, the lower rail including a vertical plate which bears against the studs and a portion extending outward therefrom which defines an upwardly extending channel for receiving the lower portion of the lower panels;

a middle rail mounted horizontally to the studs between the upper and lower rails, the middle rail including a vertical plate having a portion thereof which bears against the studs, a portion extending outward therefrom adjacent a top edge thereof which defines an upwardly extending channel for receiving the lower portion of the upper panels, and a portion extending outward therefrom adjacent a bottom edge thereof which defines a downwardly extending channel for receiving the upper portion of the lower panels;

an elongated bar spaced apart from said middle rail and mounted longitudinally thereof;

a plurality of attachment devices attached to the middle rail plate and to the bar; and a cover attached to the middle rail, the cover having a wall spaced apart from the middle rail plate to define an interior chamber therebetween, said wall having a plurality of apertures therein for receiving the attachment devices.

19. The system of claim 18, wherein the middle rail vertical plate has upper and lower portions which bear against the studs and upper and lower horizontal flanges extending outward from said upper and lower portions, said flanges having a protuberance extending substantially vertically outward from outer edges thereof, and the middle rail cover has horizontal flanges extending toward the plate from top and bottom edges thereof, said cover flanges having a longitudinal groove formed in an inner surface thereof approximately the same size as said protuberances for securing the cover to the middle rail, whereby said upper and lower portions of the vertical plate and the cover flanges define the upwardly and downwardly extending channels.

20. The system of claim 18, wherein the middle rail vertical plate has upper and lower portions which bear against the studs and upper and lower horizontal flanges extending outward from said upper and lower portions, said flanges having a protuberance extending substantially vertically outward from outer edges thereof, and the middle rail cover has upper and lower edge portions with longitudinal grooves formed in an inner surface thereof approximately the same size as said protuberances for securing the cover to the middle rail, the upper edge portion of the cover curving downward and the lower edge portion of the cover curving upward, whereby the upper and lower portions of the plate, the horizontal flanges of the plate, and the curved edge portions of the cover define the upwardly and downwardly extending channels.

21. The system of claim 18, wherein the upwardly and downwardly extending channels of the middle rail are defined by upper and lower portions of the vertical plate which bear against the studs, upper and lower horizontal flanges extending outward from said upper and lower portions, and upper and lower vertical flanges spaced apart from said upper and lower portions of the plate.

22. The system of claim 18, further comprising a base cover attached to the lower rail, and wherein a T-shaped member extends outwardly from the lower rail plate to create an upwardly extending channel and a downwardly extending channel in said lower rail plate, and an J-shaped member extends outward from a lower edge of the lower rail plate to create an upwardly extending channel in said lower rail plate, whereby the upwardly extending channel formed by the T-shaped member receives the lower portion of the lower panels, and the downwardly extending channel of the T-shaped member and the upwardly extending channel of the J-shaped member receive a portion of the base cover.

23. The system of claim 18, wherein the upper, lower, and middle rails include means for receiving a plurality of fasteners for mounting said rails to the studs, said means being adapted to completely receive the fasteners to prevent interference between the fasteners and the wall panels such that said panels bear against front surfaces of the rails plates.

24. The system of claim 18, wherein the upper rail crown member curves upward and is shaped such that a plurality of accessories can be removably secured thereto.

25. The system of claim 24, wherein the crown member has an interior chamber for the laying of cables therein.

26. The system of claim 25, wherein the crown member interior chamber is defined by a top wall including a substantially horizontal portion and an upwardly extending portion, a first side wall depending downwardly from said upwardly extending portion of the top wall at an angle away from the plate, a second side wall depending downwardly from the first side wall at an angle toward the plate, and a substantially horizontal bottom wall between the plate and the second side wall, said top wall defining an upwardly extending ledge for the placing of an article thereon, and wherein said portion extending downwardly from the crown member comprises a portion of said second side wall extending downward past the bottom wall to form said downwardly extending channel for receiving an upper portion of a plurality of upper wall panels, the second wall also having a longitudinal notch formed in an exterior surface thereof for receiving various accessories.

27. The system of claim 18, wherein each attachment device comprises a base member attached to the middle rail plate and a joint member interconnecting said base member to the bar, said base member comprising a support plate bearing against the middle rail plate and a post extending perpendicularly outward therefrom, and each joint member having a support arm which mates with a corresponding post, said joint members also having an end portion extending laterally therefrom which mates with an end portion of a bar.

28. The system of claim 27, wherein the base member posts have a chamber formed therein for receiving the support arm of the joint members, and the support plate has a plurality of apertures therein for receiving fastening means.

29. The system of claim 27, wherein the base member posts and joint member support arms have a substantially rectangular cross-section.

30. The system of claim 27, wherein the middle rail plate has at least one substantially rectangular, longitudinal channel therein, whereby a square head of support plate fastening means fits in said channel to allow the base members to be attached to the rail plate in alignment and prevent said fasteners from rotating.

31. The system of claim 27, wherein the base member posts have an aperture formed in at least one wall thereof for receiving fastening means to prevent longitudinal movement of the joint member relative to the base member.

32. The system of claim 27, wherein the cover has a sleeve extending outward from the cover adjacent the apertures, the base member post fitting inside said sleeve.

33. The system of claim 18, further comprising a seating assembly supported by the bar and movable to a desired location along said bar, said seating assembly having a backrest and a seat, the backrest having a channel formed in an upper portion thereof which is substantially the same shape as the bar such that said upper portion of the backrest slidably fits over the bar.

34. A rail system comprising:

a plurality of spaced apart studs;

an upper rail mounted horizontally to a plurality of spaced apart studs adjacent a ceiling, the upper rail including a vertical plate which bears against the studs and a horizontal crown member extending outward from a top portion thereof, the crown member having an interior chamber for the laying of cables therein, said interior chamber being defined by a top wall including a substantially horizontal portion and an upwardly extending portion, a first side wall depending downwardly from the top wall at an angle away from the plate, a second side wall depending downwardly from the first side wall at an angle toward the plate, and a substantially horizontal bottom wall between the plate and the second side wall, said top wall defining an upwardly extending channel for the placing of a longitudinal light therein, and said second side wall extending downward past the bottom wall to form a downwardly extending channel for receiving an upper portion of a plurality of upper wall panels, the second wall also having a longitudinal notch formed in an exterior surface thereof for receiving various accessories;

a lower rail mounted horizontally to said studs adjacent an abutting surface such as a floor, bathtub, or shower pan, the lower rail including a vertical plate which bears against the studs, a T-shaped member extending outwardly therefrom to create an upwardly extending channel and a downwardly extending channel, and a J-shaped member extending outward from a lower edge thereof to create an upwardly extending channel, whereby the upwardly extending channel formed by the T-shaped member receives a lower portion of a plurality of lower panels;

a base cover releasably secured to the lower rial, said base cover having a portion extending therefrom which fits into the downwardly extending channel of the T-shaped member and the upwardly extending channel of the J-shaped member;

a middle rail mounted horizontally to said studs between the lower and upper rails, the middle rail including a vertical plate having a portion thereof which bears against the studs and horizontal flanges extending outward from top and bottom edges thereof, the horizontal flanges having a protuberance extending substantially vertically outward from outer edges of said flanges for receiving a cover;

a plurality of base members including a support plate bearing against the middle rail plate and a substantially rectangular post extending perpendicularly outward therefrom, the support plate having a plurality of apertures therein for receiving fastening means, said post having a rectangular chamber formed therein and an aperture formed in at least one wall thereof for receiving fastening means;

a plurality of joint members having a support arm for insertion into the interior chamber of the base member post, and a pair of substantially rectangular, opposing hub portions extending perpendicularly therefrom in an angular relation relative to a vertical plane, at least one wall of the support arms having an aperture therein in alignment with the aperture in a corresponding base member post for the insertion of fastening means therein;

a cover having a wall spaced apart from the middle rail plate to define an interior chamber between said cover and plate, the cover having horizontal flanges extending inward from top and bottom edges thereof and a plurality of substantially rectangular sleeves extending outward therefrom which receive the support plate posts, said flanges having a longitudinal groove formed in a bottom portion thereof approximately the same size as the protuberances extending from the flanges of the middle rail plate for securing the cover to said plate, and at least one wall of the sleeve having an aperture therein aligned with the apertures in a corresponding base member post and joint member support arm for receiving fastening means; and a plurality of elongated support bars spaced apart from the cover, said bars having end portions which mate with the support arm hub portions for securing said bars in a substantially horizontal position, said bars also having a substantially rectangular cross-section defined by four exterior surfaces which are positioned at an angle relative to a vertical plane.

* * * * *